United States Patent [19]

Tsuchiya et al.

[11] Patent Number: 5,067,612

[45] Date of Patent: Nov. 26, 1991

[54] SHRINK FILM PACKAGE HAVING PERFORATED FOLDED STRIP

[75] Inventors: Mikio Tsuchiya, Chiba; Shoichi Kawase; Hirofumi Watanabe, both of Tokyo, all of Japan

[73] Assignees: Honshu Sangyou Kabushiki Kaisha; Honshu Paper Co., Ltd., both of Tokyo, Japan

[21] Appl. No.: 645,331

[22] Filed: Jan. 2, 1991

Related U.S. Application Data

[62] Division of Ser. No. 470,266, Jan. 25, 1990, abandoned.

[30] Foreign Application Priority Data

Jan. 26, 1989 [JP] Japan ..... 1-15163
Jan. 5, 1990 [JP] Japan ..... 2-118

[51] Int. Cl.[5] ..... B65D 65/28; B65D 71/08
[52] U.S. Cl. ..... 206/497; 229/87.05
[58] Field of Search ..... 206/497, 613, 620, 631, 206/633, 608, 611

[56] References Cited

U.S. PATENT DOCUMENTS

| | | | |
|---|---|---|---|
| H9 | 1/1986 | Ashmore | 206/497 |
| 2,296,951 | 9/1942 | Rosen et al. | 206/623 X |
| 2,545,243 | 3/1951 | Rumsey, Jr. | 206/497 |
| 2,973,087 | 2/1961 | Rohdin | 206/613 X |
| 3,214,078 | 10/1965 | Leezer | 206/631 X |
| 3,221,975 | 12/1965 | Zoeller et al. | 206/631 X |
| 3,261,538 | 7/1966 | Jones et al. | 206/613 X |
| 3,403,840 | 10/1968 | Mathes | 206/613 X |
| 3,456,780 | 7/1969 | Forman . | |
| 3,480,179 | 11/1969 | Rowland | 206/613 X |
| 3,668,061 | 6/1972 | Forman . | |
| 3,679,048 | 7/1972 | Fujio | 206/497 |
| 3,873,018 | 3/1975 | Donnay | 206/497 X |
| 4,658,963 | 4/1987 | Jud | 206/633 X |

FOREIGN PATENT DOCUMENTS

| | | | |
|---|---|---|---|
| 55-86758 | 6/1980 | Japan . | |
| 55-163128 | 12/1980 | Japan . | |
| 59-408 | 1/1984 | Japan . | |
| 01-67069 | 6/1989 | Japan | 206/497 |
| 638729 | 6/1950 | United Kingdom | 206/631 |
| 853924 | 11/1960 | United Kingdom | 206/613 |

*Primary Examiner*—Bryon P. Gehman
*Attorney, Agent, or Firm*—Fleit, Jacobson, Cohn, Price, Holman & Stern

[57] ABSTRACT

Packaging with heat-shrinkable film wherein an article has on its surface a heat-shrinkable film in the longitudinal or traversing direction, a tape-shaped overlapping portion is formed on said film, the tape-shaped overlapping portion is partially welded, and tear-off perforations are made in lines along the longitudinal direction thereof so that tearing off the tape-shaped overlapping portion along the perforations opens the package to allow the article to be taken out.

8 Claims, 12 Drawing Sheets

SHRINK FILM PACKAGE HAVING PERFORATED FOLDED STRIP

This is a divisional of application Ser. No. 07/470,266, filed Jan. 25, 1990, now abandoned.

BACKGROUND OF THE INVENTION

1. Field of the Invention

The present invention relates to a shrink film package having a tape-shaped opening and method for making thereof.

2. Description of the Prior Art

In the past, heat-shrinkable film has been widely utilized in the packaging of many individual packages or bulk packages in units for distribution or transportation. However, the unpacking operation of such packages has been difficult due to the packaging film itself being hermetically confined over the outer surface of the product by the shrinking effect. To improve the unpacking operation, the following examples of measures have been taken, with reference to FIGS. 26–32, namely:

(1) Slits 101 are previously provided on the shrinkable film of the package 100 at the opening side thereof (FIG. 26).

(2) Sealing portions of the packaging film are overlaid and adhered together, providing a reinforced grasping portion to be utilized as a tear-off tab 102 (FIG. 27).

(3) After or before the shrinking treatment of the film, tear off slit 103 or 104 is provided to the sealing portion of the packaging film (FIGS. 28 and 29).

(4) On the sealing portion of the packaging film, a reinforced article having higher strength than said film (such as string and tape) 105 is overlaid and adhered thereto (FIG. 30).

(5) As disclosed in the Japanese Laid Open Patent 55–163128, after the shrinking treatment of the film, perforation 107 is provided in the center of the entire side surfaces of the package using a knife roll 106 (FIG. 31).

(6) After the shrinking treatment of the film, perforations 108 are provided around the entire package traversing the sides thereof (FIG. 32).

Conventionally, in order to have easy opening of the shrink film package, the above measures have been taken and it is also known, similarly to (4) above, that: a separate heat-shrinkable tearing tape other than packaging film is welded to the packaging film at the time of the shrinking process of the shrink film package (Japanese Laid Open Utility Model 55–86758); or a plastic tape or paper tape of different material than the packaging film is incorporated into the opening portion of the package to easily break off therefrom through the tape (Japanese Patent Publication 59–408). All of these measures have inconveniences as hereinafter mentioned which reduce their commercial value.

The problems are that according to the method of (1) aforementioned, the strength of the package is not only decreased due to the slit in the packaging film thereto, but also a slit does not always work to tear off the film, depending on the film used. According to the method of (2) aforementioned, since the breaking point is harder than the base film because of the reinforcement, tearing off the film is so difficult that the working efficiency of the opening is worse than the method of (1). Also, the opening is not regular which causes the further problem that the break in the surface of the film is jagged with an unattractive appearance. According to the method of (3) aforementioned, there are the disadvantages of providing a complicated device to make the slit and the slit decreases the entire package strength. According to the method of (4), the different nature of the reinforced article adhered to the packaging film increases the difficulty of tearing off, and further, the different materials of the reinforced article and the packaging film has the disadvantage that the appearance of the package after the shrinking treatment becomes less desirable. And the method according to (5) above creates the problem that it is dangerous to scratch the package so that the applications are limited to hard surface and flat-shaped packages, and also the perforations expand and the film breaks while shrinking is done, and thus the package strength is decreased.

While polyethylene film has been generally used for shrinkable film for middle or heavy weight packages, or for large size of bulk packing, it is difficult to unpack the package because the film is flexible and expandable so that the tear-off opening is not able to break off cleanly along a line of perforations. In addition , when the shrink package is made by a sheet of perforated polyethylene film, hot-air-blowing temperature in the shrink tunnel is set near the temperature of the melting point of polyethylene, and thereby the perforations are entirely welded and expanded, causing breaking of the film.

BRIEF SUMMARY OF THE INVENTION

A first object of the present invention is to provide a shrinkable film package having a good appearance and a clean end at the torn-off opening.

Another object of the present invention is to provide a shrinkable film package enabling an easy tearing-off operation by forming a tape-shaped overlapping portion of the film thereof on the surface of the packaging film with perforations.

A further objection of the present invention is to provide a package enabling shrinkable film bulk packing and separate packed light-weight shrinkable film packaging.

A still further object of the present invention is to provide a method for making a shrinkable film package including forming a tape-shaped overlapping portion on the film with perforations.

The present invention is a tape-shaped portion overlapped at least twice with the tear-off perforations utilizing heat-shrinkable film by which a packed article is shrink-wrapped.

This tape-shaped overlapping portion is formed by a same kind of film of the packaging film to overwrap the packed article on the wrapped position in either the longitudinal or transverse direction against the packed article. While the tape-shaped overlapping portion is overlapped by such film more than twice, shrinkage in the shrink tunnel thereof is slight so as to provide a shrink film package which has hermetically confined the packed article by mean of shrinkage of the entire film except for tape-shaped overlapping portion. Further, the tape-shaped overlapping portion have two lines of perforations along with longitudinal direction toward said overlapping portion, and also at least one of a tear-off indent or notch is formed between two lines of perforations.

The above tape shaped overlapping portion overlaps the film prior to the process to overwrap the packed article or during such process, and perforations are provided at the same time to apply the partial heat welding to the overlapped portion. The film overlapping is formed by the following:

A first method is to overlap a certain width of both side ends of the film while overwrapping the packed article. The second method is that two sheets of packaging films are drawn so as to overlap each one side end, and while the packed article is overwrapped, said overlapping portion is welded to be as an overlapping portion. The third method is that while cutting a one side of a sheet of continuous packaging film to a tape shape, the base film is drawn toward the center and then such cut tape shape portion is overlaid to the base film. The fourth method is that in taking a shift widthwise in the center of the continuous film before overwrapping the packed article, the shift portion is overlapped to make a certain width of tape shape overlapping portion.

When forming a shrink film package, overlapped film portion is welded and integrated by the hot air blower in the shrink tunnel. No damage occur to the perforation orifices of the tape shaped overlapping portion by hot air blower, as excavated. For opening, if the overlapped portion of said film is torn off, it can be easily pulled out and peeled off clearly from predetermined perforated position since the film is overlapped two times giving thick walls and strength thereto.

When the present invention is applied for bulk packing of light-weight packagings, the tape-shaped overlapping portion is placed along at least one boundary at a selected line between the bulk-packed packages among the bulk-packed group of the packed articles. For unpacking, by tearing off the tape-shaped overlapping portion along the tear-off perforations, the packages separate at the boundary. As a result, the side wall of each packed article facing the boundary is exposed. The boundary portion thereby divides two separate packages, each containing more than two packages.

BRIEF DESCRIPTION OF THE DRAWINGS

The above and other objects, features and advantages of the present invention will become apparent from the following description and the appended claims taken in conjunction with the accompanying drawings which show by way of example preferred embodiments of the present invention and in which like component parts are designated by like reference numerals through the various figures wherein:

DESCRIPTION OF THE PREFERRED EMBODIMENTS

Figure 1:
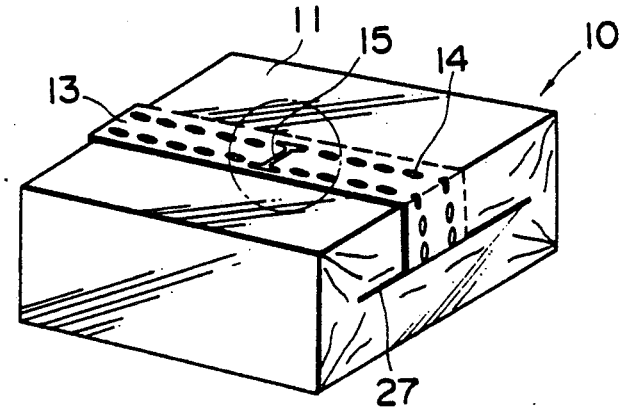
FIG. 1 is a perspective view of a shrinkable film package embodiment of the present invention.

Referring first to FIG. 1, there is shown a perspective view of the shrink film package in accordance with the present invention.

In the drawing, numeral 10 designates a shrinkable film package, 11 is a heat shrinkable packaging film such as polyethylene, polypropylene or polyvinyl chloride. And numeral 13 is a tape shaped overlapping portion which is formed, during overwrapping the packed article around the sides, both of the ends of packaging film 11 are also overlapped.

Figure 2:
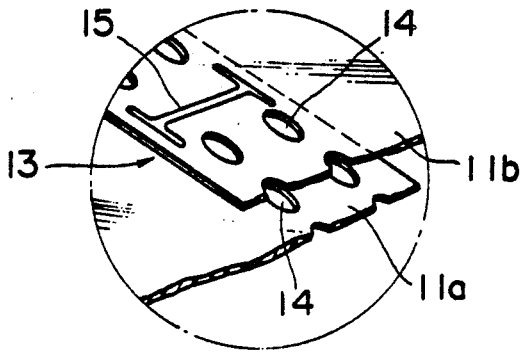
FIG. 2 is an enlarged perspective view of a tape shaped overlapping portion encircled in FIG. 1.

As hereinafter described, this tape-shaped overlapping portion comprises double-overlapped film welded together by means of heat sealing or ultra-sonic welding partially or entirely, and two parallel lines of the tear-off portions 14 are formed along the overlapped portion. Numeral 15 is a notch for tearing off formed on the tape-shaped overlapping portion. FIG. 2 is an enlarged view of tape-shaped overlapping portion perforations, and notch 15.

Figure 3:
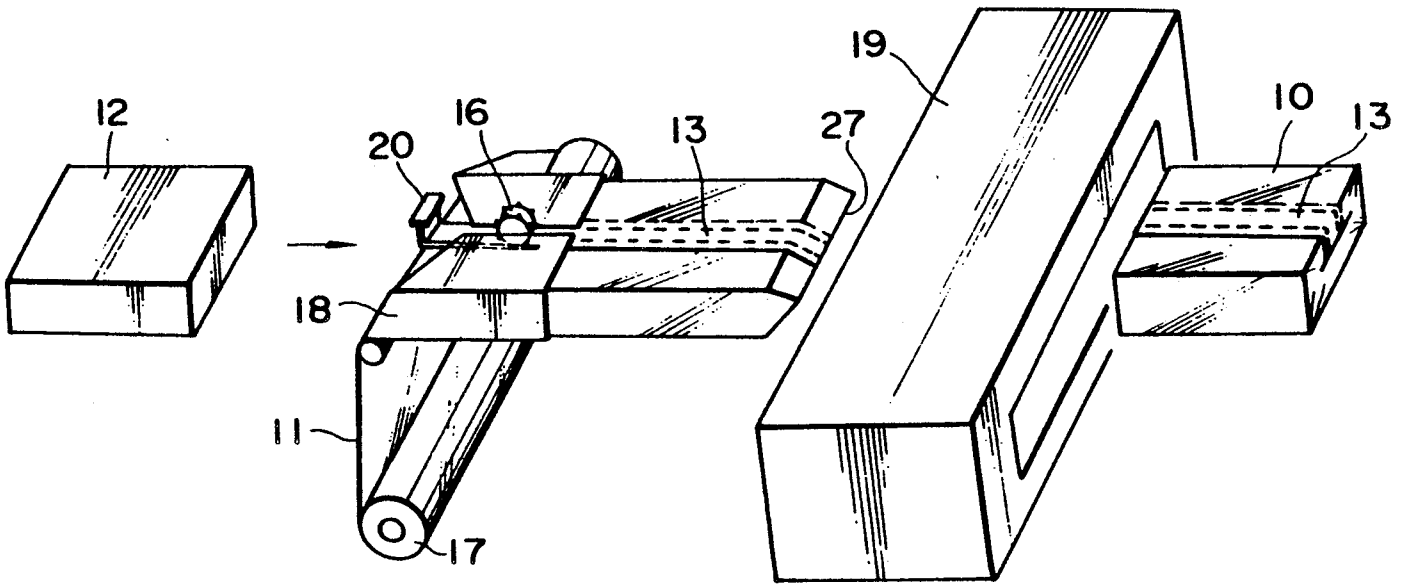
FIG. 3 is a perspective view showing a packaging process for the shrinkable film package in FIG. 1.
Figure 4:
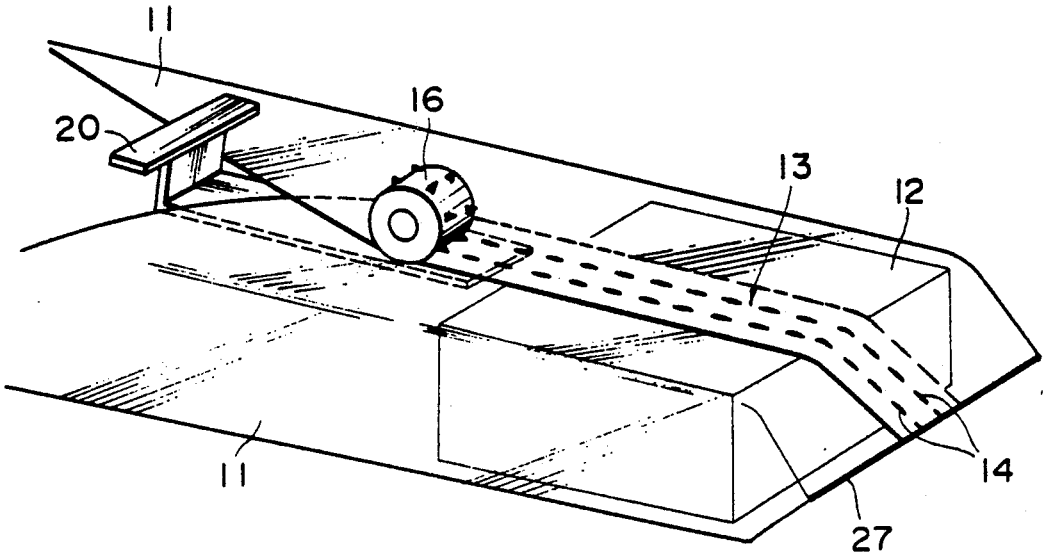
FIG. 4 is an enlarged perspective view showing the forming of a tape shaped overlapping portion in FIG. 3 and the tear off perforations thereof.

The tear off perforations 14 may be processed after welding of each overlapping packaging film, however, such perforating process can be performed during welding of the overlapping film simultaneously. Now describing the process thereof, as shown in FIG. 3, the article 12 is loaded from one side and it is packaged by passing into and through the film former 18. In the film former portion, as shown in FIG. 4, the perforation roller 16 which has a built-in heater (not shown) is kept in contact with the tape-shaped overlapping portion 13 of the packaging film, and then the tear-off perforations 14 are formed while both side edge portions 11*a*, 11*b* (FIG. 2) of the overlapped packaging film are partially heated. Under the perforation roller 16, supporting block 20 is provided to support the overlapping portions of the running film 11. The tape-shaped overlapping portion is heat welded in the vicinity of the perforation blade by the blade of the perforation roller 16. At same time, it is desirable that the tear-off notch 15 is simultaneously formed.

When the packed article 12 is overwrapped by the heat shrinkable packaging film as above mentioned, the tape. shaped overlapping portion 13 is formed on the packaging surface by overlapping both edge portions of packaging film 11, and then such package is transferred to the shrinking tunnel where each overlapping portion is welded and integrated by the hot-air blower at about 160° C., and thus a high strength for the tape-shaped overlapping portion can be formed. No damage occurs to the perforation orifices 14 by the hot-air blower in the shrinking tunnel, since the film thereof is strengthened by the overlap.

For opening such shrinking film package 10, notch 15 formed in the tape-shaped overlapping portion 13 is gripped by the fingers and the tape-shaped overlapping portion surrounded by the two parallel lines of perforations 14 can be easily, cleanly and attractively torn off along the direction of the perforations 14 since the tape-shaped overlapping portion is strengthened due to the two overlapped films.

Notwithstanding that the drawings illustrate the notch 15 placed on the top surface of the package 10, it may be placed on either side surface or rear surface whichever is desirable as the location on the tape-shaped overlapping portion 13. Also the configuration of the packaged article is not limited to those of such square shape as illustrated, but may be circular, polygonal or any other irregular shape as desired, and also may be a bulk package of a plurality of stacked packagings.

Now an example of applying the method of the above shrinking film packaging will be described in detail in accordance with diagrammatic illustrations in FIGS. 3 and 4. When the packed article 12 is overwrapped by the shrinking film 11, which is fed from a film feeding roll 17 at the lower position in the drawing, the packaging film is formed into tubular shape while advancing through a film former 18. At this stage, both side edges of 11*a*, 11*b* are overlapped and the tape shaped overlapping portion 13 is formed in the same direction as the packaging film flows, and then the overlapped portion 13 is welded partially as the tear off perforations 14 are formed. Overwrapped remainder portions of the film at the front end is cut and simultaneously sealed portion 27 is made by sealing. Thereafter, the film is placed into the shrinking tunnel 19 heated by hot air at about 160° C. and as a result article 12 becomes a shrinking film package. The packaging film 11 for shrinkage is exposed in the hot-air blower in the shrinking tunnel so that it is wrapped and hermetically confines the outer surface of article 12. It is unloaded from tunnel 19 by a conveyor (not shown), and subsequently introduced into a cooling process if desirable, and then taken out as a finished package (i.e. as a shrinking film package 10).

Figure 5:
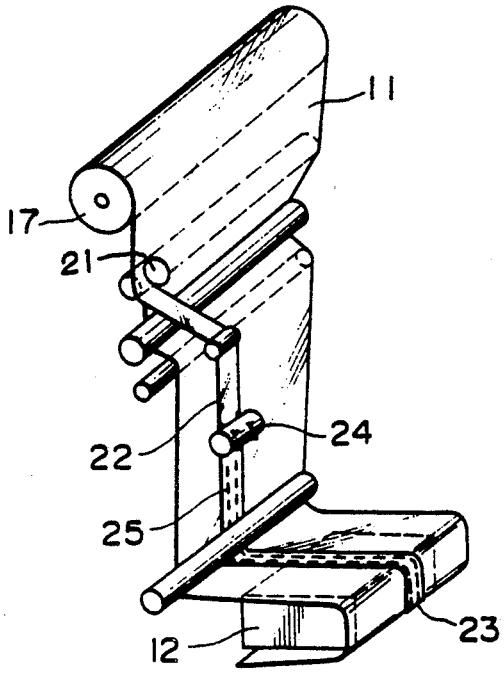
FIG. 5 is a perspective view showing another embodiment of a packaging process with shrinkable film in accordance with the invention.

The tape-shaped overlapping portion 13 of the shrinking film package 10 can be formed in other ways than that shown in FIG. 4 such as overlapping on both side edges of the packaging film, for example as shown in FIG. 5, by tape-shaped film 22 cut out from a side edge of the packaging film 11 by knife roll 21 in a narrow width, and overlapped onto the same film 11, whereby the tape-shaped overlapping portion 23 can be formed. In this embodiment, the tape- shaped overlapping portion is, as in the previous embodiment, partially welded by perforation roller 24 which has a built-in heater (not shown), and after the tear off perforations 25 are formed along with the overlapping portion, the article 12 is overwrapped by film 11, and the film ends are overlapped at the base position. Thereafter it is transferred to the shrink tunnel where it is exposed to the hot air for heat shrinking.

Figure 6:
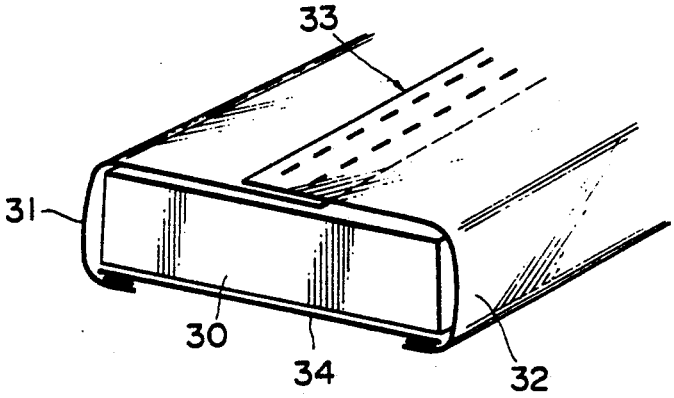
FIG. 6 is a perspective view showing another embodiment of the present invention.
Figure 8:
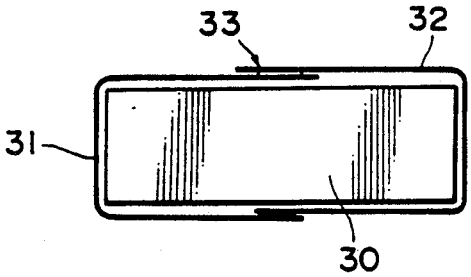
FIG. 8 is a side view showing another embodiment of the package of the invention.

FIGS. 6 and 8 illustrate preferred embodiments in accordance with the present invention for packaging a large size article with a wide width, by using two sheets of heat shrinkable packaging films 31, 32, and the tape-shaped overlapping portion 33 of the packaging film is formed on the packaging surface by overlapping one side edge of each film. In the example shown in FIG. 6, another sheet 34 is interposed in the base surface of article 30, and both edges are welded at lower edges of packaging films 31, 32. FIG. 8 is an example where each lower edge of packaging films 31, 32 is directly overlapped together. In either embodiment of FIG. 6 or FIG. 8, the edges can be welded by exposing to the hot air blowing in the shrinking tunnel during the shrinking treatment of the film, or they can be adhered by using a hot-melt adhesive before the shrinking treatment, whichever is desirable.

Figure 7:
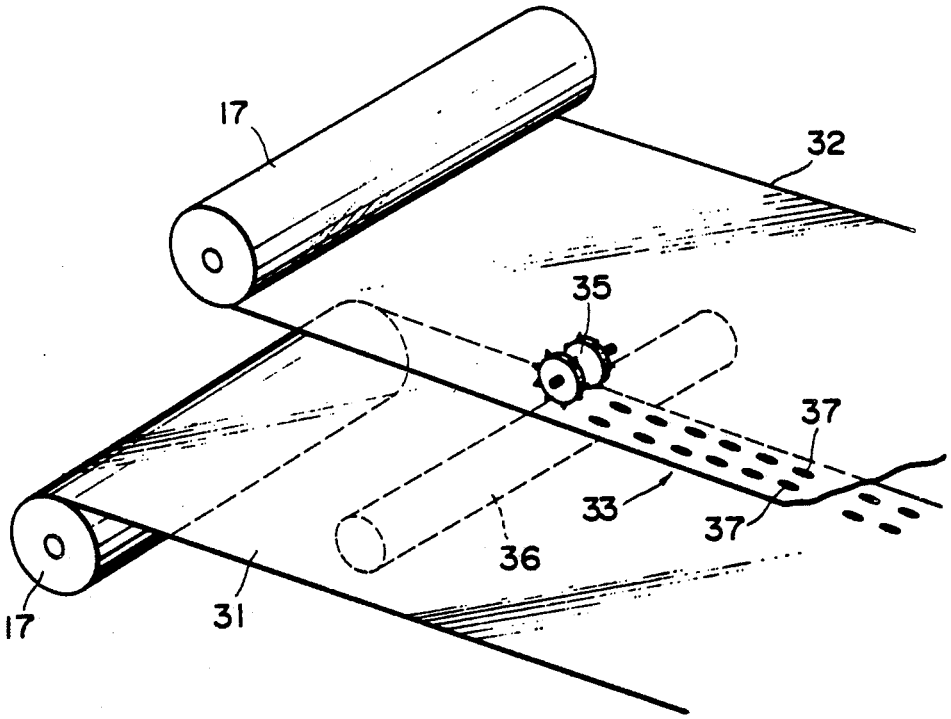
FIG. 7 is a perspective view showing the forming of a tape shaped overlapping portion using 2 sheets of packaging films and the tear off perforations thereof.

FIG. 7 is an explanatory drawing showing a method of partial welding of the tape shaped overlapping portion 33 of the two sheets of heat shrinkable packaging films 31, 32, and a method of forming the tear-off perforations on such overlapping portions. The tape shaped overlapping portion 33 is, as in the previous embodiment, partially welded by a perforation roller 35 which has a built-in heater (not shown) and supporting roller 36, and the tear-off perforations 37 can be formed along with the overlapping portion.

Figure 9:
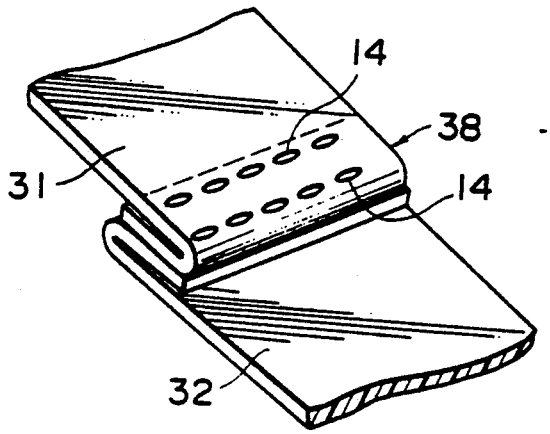
FIG. 9 is a perspective view of an embodiment wherein the tape shaped overlapping portion is formed by overlapping four times according to the present invention.

FIG. 9 shows an embodiment wherein each edge of film 31, 32 is folded for a certain width, respectively, and both folded portions are overlapped to form a quadruple tape-shaped overlapping portion 38.

The shrink film package in accordance with the present invention comprises forming the tape-shaped overlapping portion of the film on the packaging surface by overlapping both side edges of the packaging film or overlapping each end of two sheets of the packaging films, and welding such overlapping portions to integrate them together, and then to form the tear off perforations, whereby no knife, special tearing-off tape, or strain is necessary to unpack the package. Furthermore, since the tape shaped overlapping portion is overlapped with more than two film layers and welded, integrated to become thicker, it not only has greater strength, but also is prevented from breaking in the shrinking tunnel.

For opening, the shrinking film packaging can be easily torn off with a clean end of the broken-off opening along the perforations provided along the tape-shaped overlapping portion.

Figure 10:
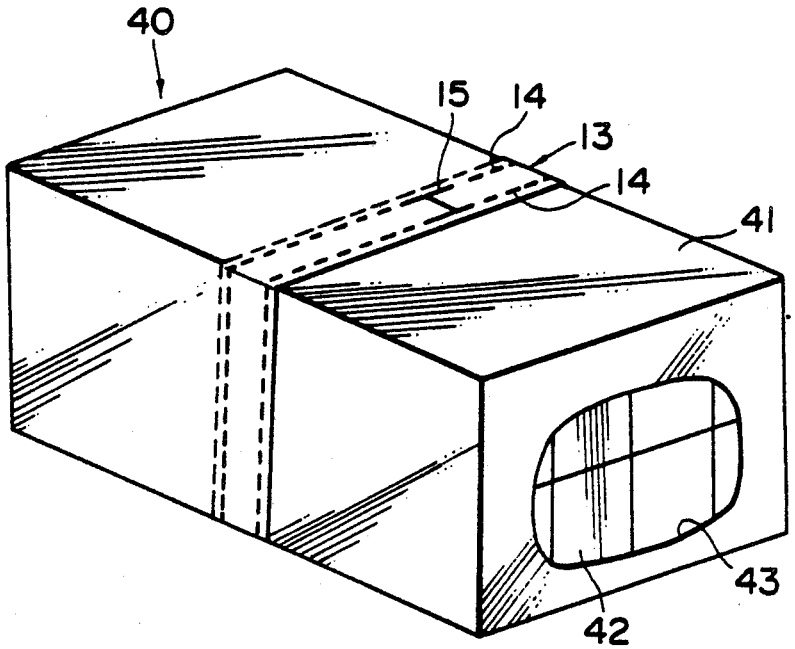
FIG. 10 is a perspective view showing an embodiment of the present invention applied for bulk packaging of light-weight packages.

FIG. 10 exemplifies bulk packaging of light weight packagings 40. A number of light weight and relatively small size packed articles 42 are collectively arranged, and the shrinking film 41 is wrapped over the outer periphery thereof, and then shrunk in the shrinking tunnel so as to form a shrinking film package 40 having an opening 43 on the side of the end thereof. Around the sidewalls of the package 40, the tape-shaped overlapping portion 13 is provided formed by the film. In the overlapping portion 13 the tear-off perforations 14 and notch 15 are provided.

The position of the tape-shaped overlapping portion 13 can be freely located, however, if it were placed along a boundary which is selected in advance among the group of the plurality of the small packagings arranged in tiers or lined up, the package ca be separated along the boundary upon tearing-off portion 13. Then, side walls of the packed articles 42 facing the boundary are exposed whereby the boundary divides the packaging into two separate packages, that is to say separate packs.

FIG. 11 through FIG. 18 show respective example of bulk, pack packaging of light weight packagings with a tray.

Figure 12:
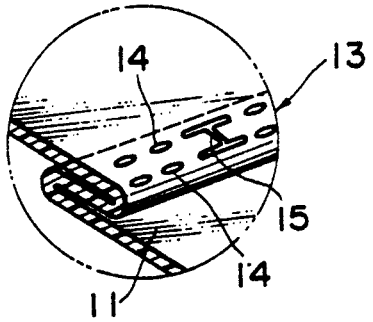
FIG. 12 is an enlarged perspective view of the tape shaped overlapping portion in FIG. 11.
Figure 11:
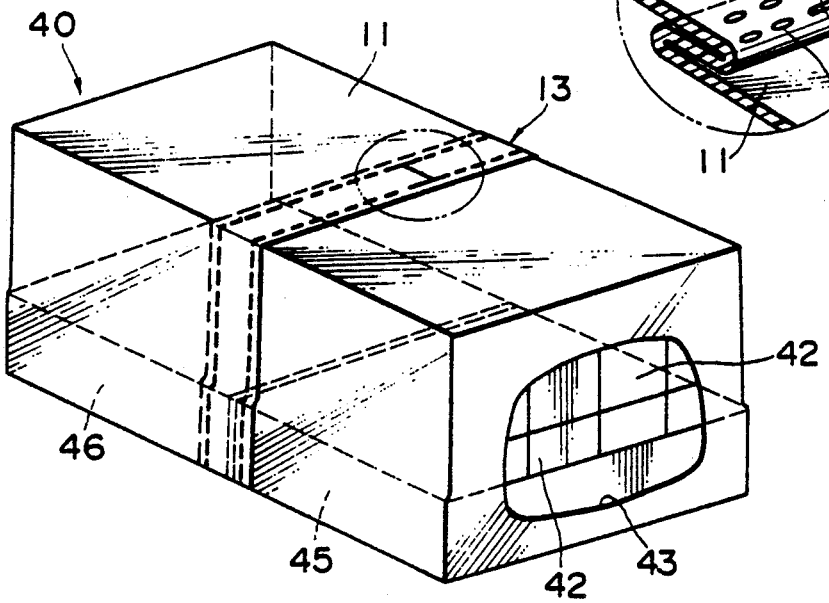
FIG. 11 is a perspective view showing an embodiment of the present invention applied for bulk packaging of light-weight packages with trays.

In FIG. 11, while many of the small packed articles 42 are arranged in tiers or lines on trays, the film 11 is wrapped, and a shrinking film package 40 is formed. As a tape-shaped overlapping portion 13 here, one part of the film 11 is slacked and three way overlapping is utilized as shown in FIG. 12, which is an enlarged view of the circled portion of FIG. 11. In such overlapping portion 13, as in FIG. 10, two lines of perforations 14 and the tear-off notch 15 are formed.

Figure 13:
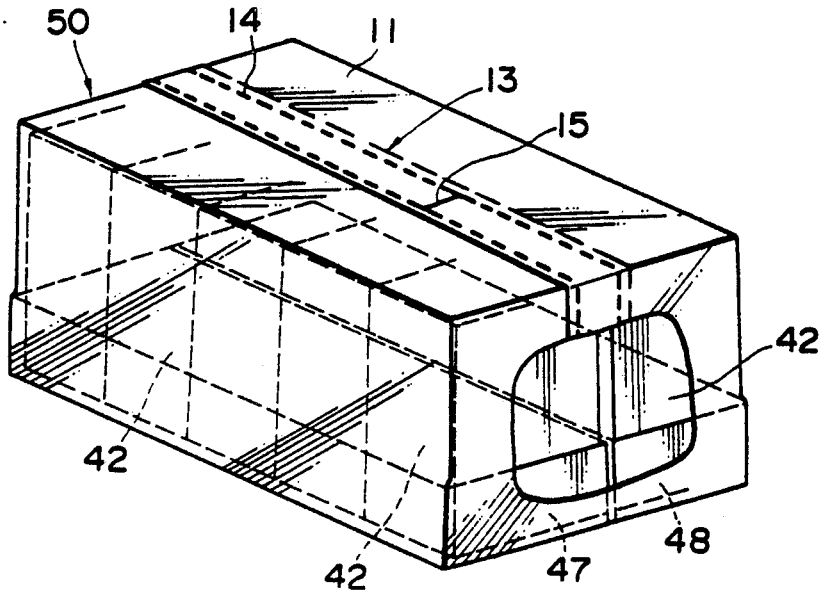
FIG. 13 is a perspective view showing an embodiment of the present invention wherein the tape shaped overlapping portion is formed in the longitudinal direction of bulk packaging of light weight packages with trays.

FIG. 13 shows a package 50 which exemplifies using two trays 47, 48, and a tape-shaped overlapping portion 13 is placed at the boundary of the packages 42 defined by trays 47, 48. Upon tearing off the tape-shaped overlapping portion 13, the package can be divided into two groups between left tray 47 and right tray 48 while they keep each group of bulk packages in place, whereby the shrinking film separate packaging can be realized.

Figure 14:
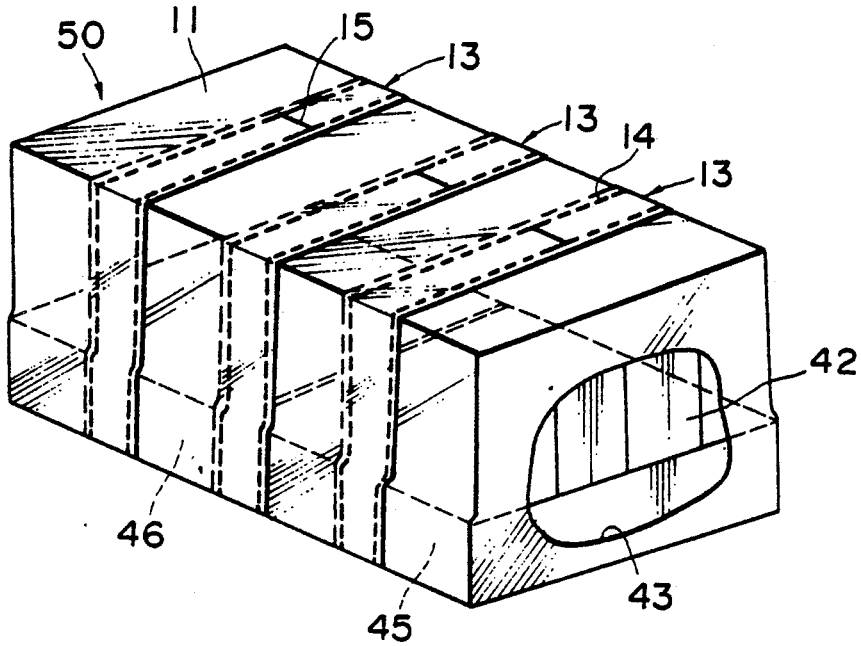
FIG. 14 is a perspective view showing the tape-shaped overlapping portion formed at 3 positions traversing the sides of I9 the shrink film package in FIG. 11.

FIG. 14 shows an embodiment utilizing two trays 45, 46 arranged transverse to the longitudinal direction of the package 50, and three tape-shaped overlapping portions 13 are placed onto three boundaries between small sized packed articles 42 stacked together. In this configuration, when the tape shaped overlapping portion 13 at the center is torn off, the bulk package is divided into groups on the two trays 45, 46 which keep their bulk packages 42 thereon, and by tearing-off the other tape shaped overlapping portions, more separate pack conditions per tray can be realized. After separation, more precise segregation can be realized as per tray 45, 46. Further, if some additional partitions (not illustrated) are interposed between each division line of the packed articles, division per partition is also possible.

Figure 15:
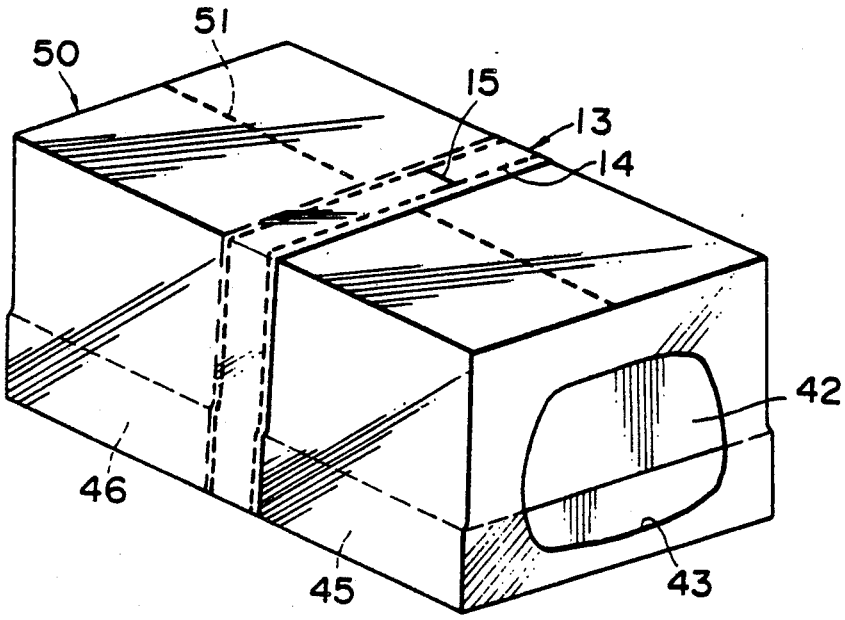
FIG. 15 is a perspective view of an embodiment in which perforations are provided in the direction transverse to the tape shaped overlapping portion on the package in FIG. 11.

FIG. 15 is a perspective view showing an embodiment after separation of left and right trays 45, 46 in FIG. 14, in order to divide further separate packed articles 42 on a tray, wherein perforations 51 are provided toward across the tape-shaped overlapping portion 13 on the top surface of the package 50. Although in this embodiment the bulk package is exemplified with trays, it is preferable to utilize corrugated paper, or foamed polystyrene boxes, or one tier or multi-tier arrangements of such, together with the forming of perforations 51.

The description will hereafter relate to both edges of the heat-shrinkable film on the bottom surface of the bulk package in accordance with the present invention.

The bottom surface of the bulk package in accordance with the present invention is formed in the condition where either both edges of the heat-shrinkable film extending from both sides of wrapping are overlapped together, both edges are facing each other, or both edges are spaced exposing a certain area at the base of the package.

Figure 16:
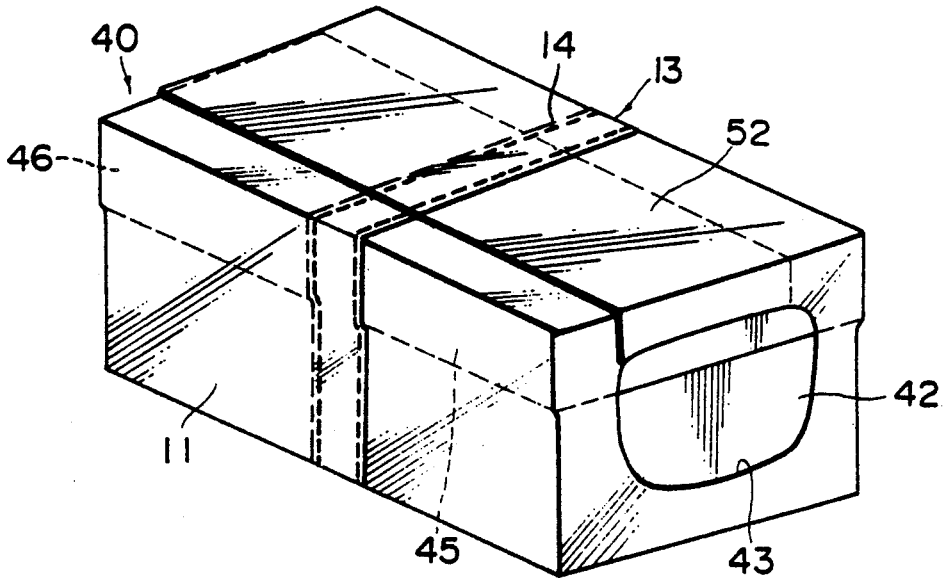
FIG. 16 through FIG. 18 are further perspective view of shrinkable film packages in accordance with the invention.

FIG. 16 shows bulk package 40 illustrated in FIG. 11 up side down, wherein the bottom at the upper portion in the drawing has both edges of the heat shrinkable film extending from both sides of the wrapping overlapped together, whereby two sheets of the heat shrinkable film are overlapped forming two layers in part of the bottom of the package. By forming two film layers overlapping in part of the bottom, a reinforcement to the tape-shaped overlapping portion 13 for the bottom can be produced when the packed article 42 is of heavy weight. Such overlapped portion 52 can be obtained by overlapping each end of film through welding in the shrinking tunnel. When applying each end of the film facing the bottom, hot melt adhesion is utilized at each edge of the film to adhere with the base of the package.

Figure 17:
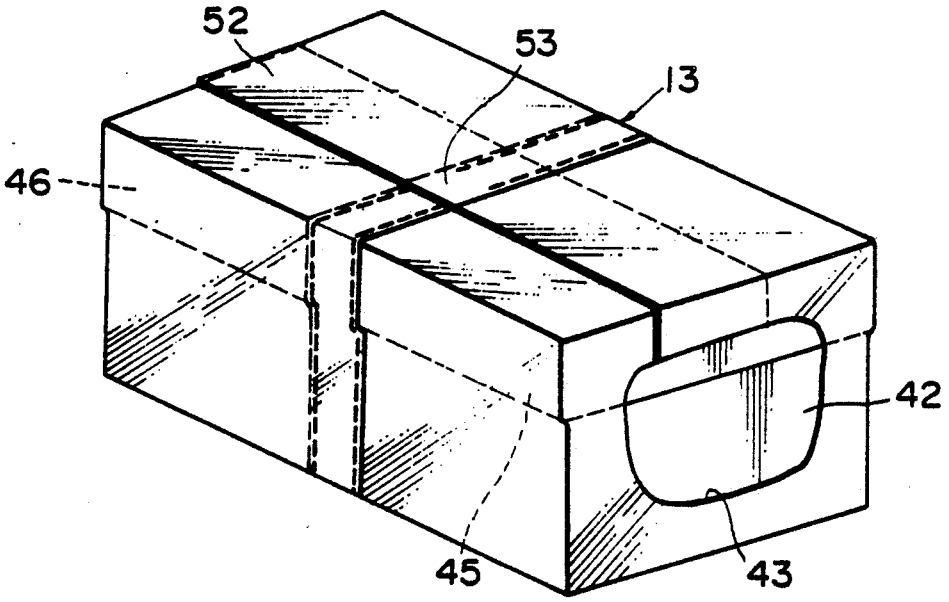

In this connection, as a reinforcement to the bottom, as shown in FIG. 17, at portion 53 perforations are omitted in part of the tape shaped overlapping portion 13. The omitted perforation portion 53 may be a relatively small area.

Figure 18:
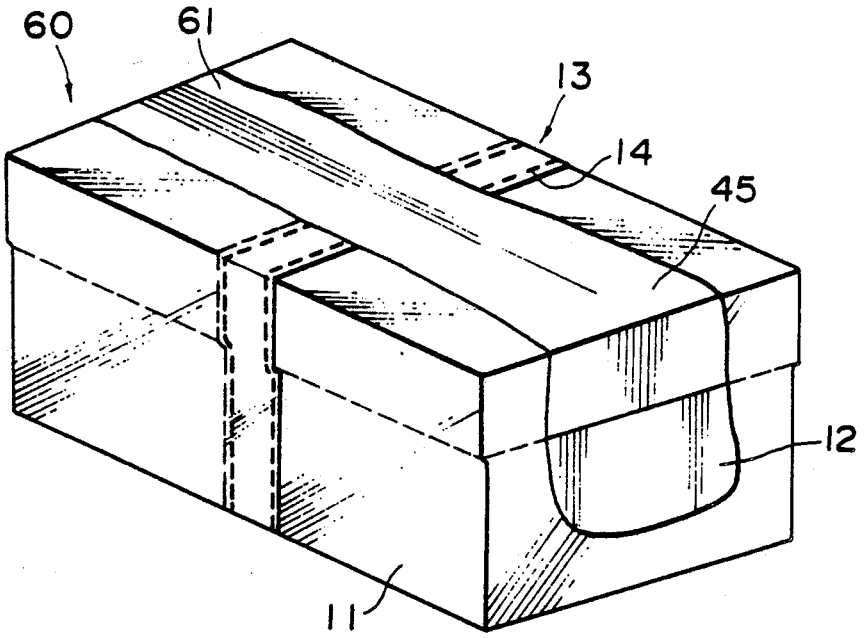

FIG. 18 shows the bottom of package 60 made by utilizing a wrapping method for closure. When the film is wrapped and shrunk, non-wrapped portion 61 appears at the bottom and on both side surfaces. The portion omitted exposes the bottom area of tray 45 prevents slipping between packagings when stacked and also a film material saving can be obtained. In this respect, adhesion of both edges of the film to the bottom of the package is made of hot-melt adhesion respectively.

Now, a description of the method of the packaging with the center portion of the film 11 slacked to form the tape-shaped overlapping portion is given.

Figure 19:
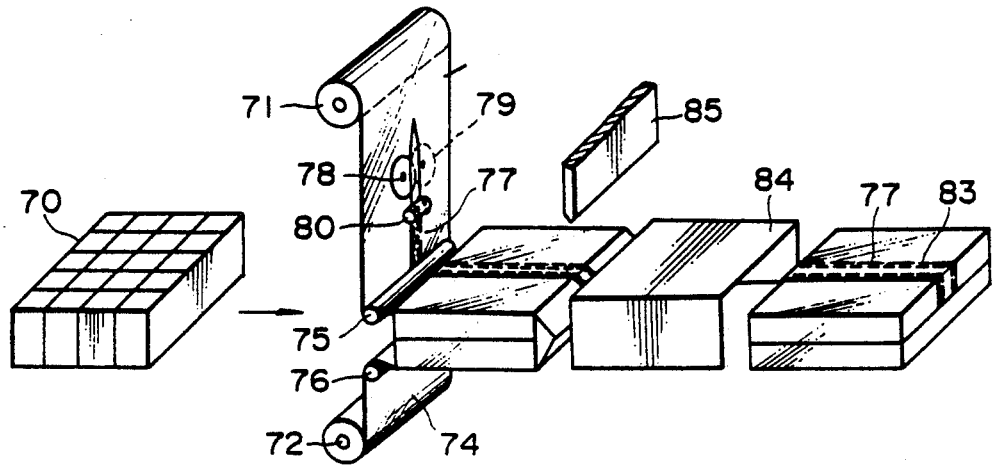
FIG. 19 is a perspective view of another embodiment showing a process of shrinkable film packaging according to the present invention.

FIG. 19 is an explanatory drawing showing a production flow scheme wherein at the time of wrapping the packed article 70 by the heat-shrinkable films feeding from two up and down positions, the tape-shaped overlapping portion is formed on one sheet of the film in the same direction of the film flow, and thereafter, the film is shrunk.

In the same drawing, two sheets of the heat-shrinkable films 73, 74 are fed by feeding roller 75, 76 from upper and lower rollers 71, 72. In this embodiment, when wrapping the packed article 70, non-shrinking treated film 73 is foldably overlapped in three ways in advance in a part of the film to form the tape-shaped overlapping portion 77.

Figure 20:
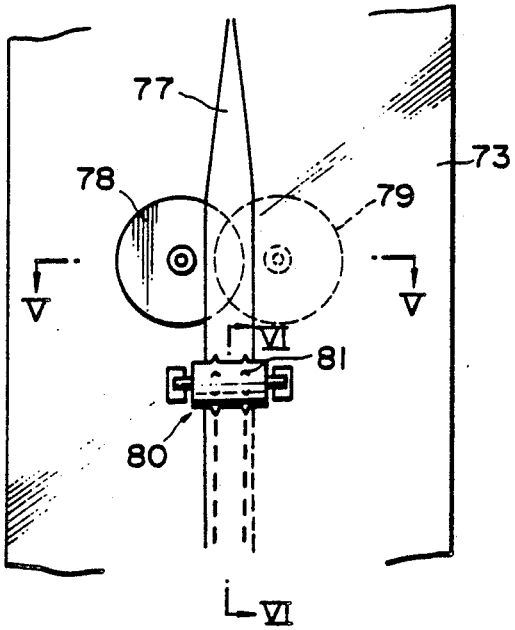
FIG. 20 is an enlarged front elevational view showing the forming of the tape-shaped overlapping portion by tucking provided in the center of the packaging film in FIG. 19.
Figure 21:
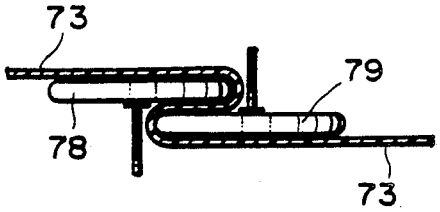
FIG. 21 is a cross-sectional view taken along the line V—V of FIG. 20.
Figure 22:
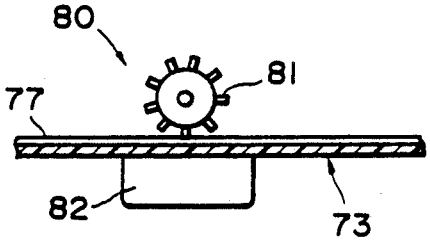
FIG. 22 is a cross-sectional view taken along the line VI—VI of FIG. 20.

In order to form the tape shaped overlapping portion 77 on film 73, one part of the continuously fed film 73 is slacked so as to form two lines of vertical tucks in parallel with the flowing direction of the film thereof by means of a pair of right and left folding guide rollers 78, 79 which are arranged alternately overlapped, and the tape-shaped overlapping portion 77 is formed by folding in three layer overlapping relationship. Subsequently such portion is heated partially or entirely, and the three layers of film are welded and integrated. For welding the overlapping portions, as shown in FIGS. 20 and 21, it is desirable that the perforations 83 are produced in the overlapped portions by cutting roller 80 which has a built-in heater (not shown), and the overlapped portion are welded and integrated at the peripheries of the perforations. In FIG. 22, numeral 81 designates the perforating blades in the circular surface of cutting roller 80, and 82 indicates the supporting block thereof.

Successively, as shown in FIG. 19, the packed article 70 is fed into the middle space between the upper and lower films 73, 74 to be wrapped, and front and rear sides, or four sides, of the packed article are hot-cut-sealed by sealer 85 in a traversing direction against the film. Thereafter, the packed article is transferred into the shrinking tunnel 84 wherein the heat-shrinkable film is shrunk by a hot-air blower so as to overwrap the packed article 70 hermetically.

Figure 23:
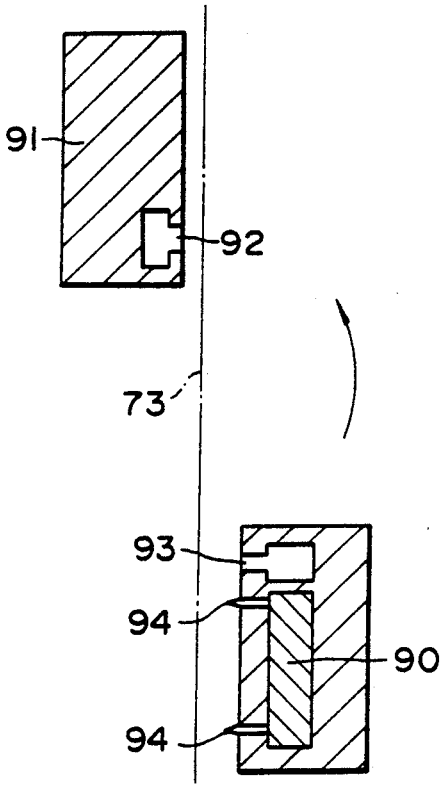
FIG. 23 is a cross-sectional view of an apparatus for forming the tape shaped overlapping portion in the direction transverse to the flowing direction of the packaging film.
Figure 24:
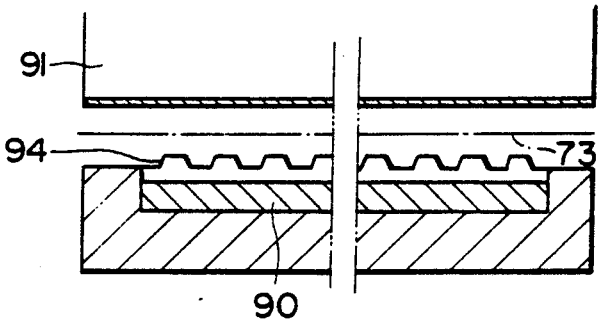
FIG. 24 is a side view in cross section of FIG. 23.
Figure 25A:
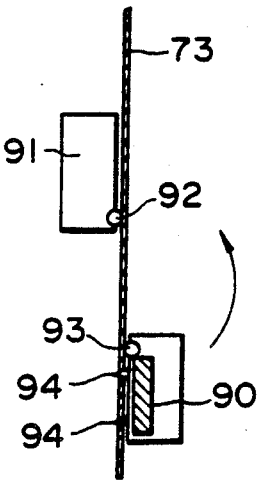
FIG. 25A through 25C are side view showing a process of film folding of FIG. 23.
Figure 25B:
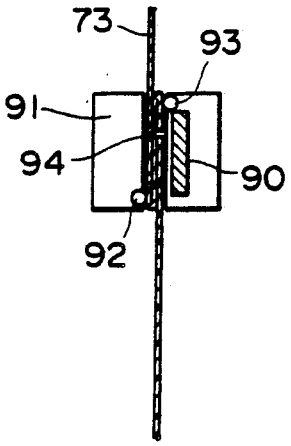
Figure 25C:
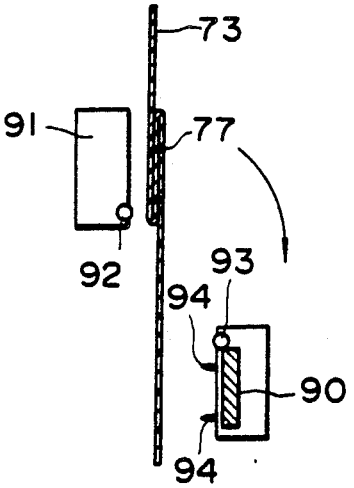
Figure 26:
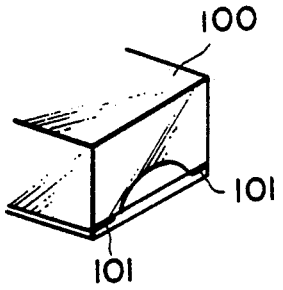
FIG. 26 (PRIOR ART)
FIG. 26 through FIG. 32 are perspective views showing examples of prior art in shrinkable film packaging, respectively.
Figure 27:
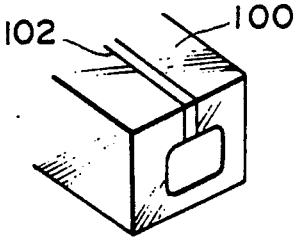
FIG. 27 (PRIOR ART)
Figure 28:
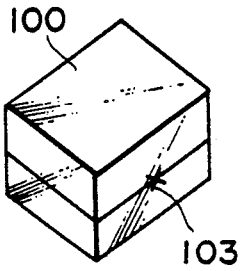
FIG. 28 (PRIOR ART)
Figure 29:
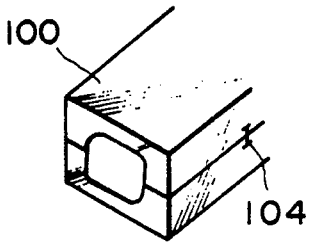
FIG. 29 (PRIOR ART)
Figure 30:
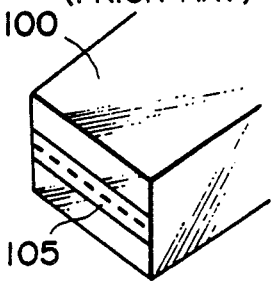
FIG. 30 (PRIOR ART)
Figure 31:
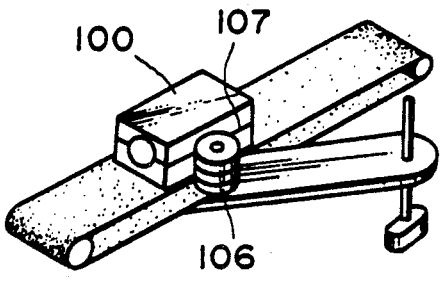
FIG. 31 (PRIOR ART)
Figure 32:
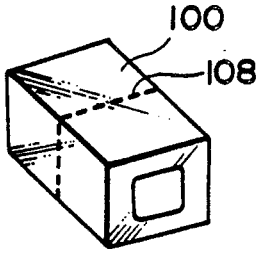
FIG. 32 (PRIOR ART)

For wrapping the packed article by the heat-shrinkable film, there is an alternative method wherein the tape-shaped overlapping portion is formed by one of the films by slacking in a transverse direction to the flowing film, then the packed article with the film thereon is made into the shrunk film package. Similar to FIG. 19, the heat-shrinkable film 73 is fed from a film roller and the article to be packaged is transferred to the middle portion thereof. And when wrapping the article 70 by film 73, the tape-shaped overlapping portion 77 is formed, in a manner as shown in FIG. 25A through 25C, in a direction transverse to the film flowing direction, i.e. in a widthwise direction. As here defined, the tape-shaped overlapping portion 77 is formed in manner that before shrinking treatment, a part of the film 73 which is intermittently fed is sequentially slacked at the time of suspension of feeding motion of the film to foldably overlap in three ways in widthwise direction to the film flow. For that purpose, as shown in FIGS. 23 and 24, the folding unit consists of a pair of upper and lower heaters with a suction mechanism and a supporting block arranged to be set on the film loading line with the heat shrinkable film 73 interposed between them. In the heater 90 at lower portion and in the supporting block 91 at the upper portion, as shown in FIGS. 23 and 24, sucking vents 92, 93 are provided to hold the film 73 in returning position thereof by suction, and these sucking vents are connected with a suction unit (not illustrated) through pipes. Further, as shown in FIGS. 23 and 24, heater 90 has the perforating blades 94. During the sequential feeding suspension of the film 73, while the heater retains the film through the sucking vents, it turns and shifts onto the supporting block 91 as indicated by the arrow in the upper position shown in FIG. 23 where a part of the film is folded and overlapped in three layers and heat-welded and perforated. Thereafter, the heater releases the film by no suction and then returns to the original position thereof.

During the sequence of motion shown in FIG. 25A through 25C of heater 90 and supporting block 91, film feeding is stopped, the film is held by suction on heater 90 and supporting block 91, the film overlapping portions 77 are welded, and the tear off perforations are formed along the overlapping portion by perforation blades 94 mounted in the heater. After the tear-off tape-shaped portion is formed in this manner, the article is interposed into the middle of the upper and the lower films and wrapped, and after wrapping, back and front sides of the article are hot-cut and sealed by sealer 85. Thereafter, the article is transferred into the shrinking tunnel 84 wherein the heat-shrinkable films are shrunk by the hot-air blower and the package is finished.

As mentioned above, when wrapping the article with the heat-shrinkable film, a part of the film is slacked in advance so as to form the vertical tucks in the same direction the film flows, or a part of the film is slacked in the direction transverse to the film flow, the film is overlapped in three layers, the overlapped portion is partially or entirely welded and integrated, and simultaneously or after welding the tear-off perforations are formed on the overlapping portions, and thereafter the film is heat shrunk.

We claim:

1. A shrinking film package having a tape-shaped tear-off portion comprising:

at least one article;

a heat-shrinkable film tightly wrapped around at least part of said at least one article;

a longitudinal pleat in said film forming a folded strip of three layers of overlapping film;

two substantially parallel lines of perforations extending along at least part of said strip of overlapping film; and said three layers of overlapping film being at least partially welded together so that said perforations and three layers of overlapping film provide a tape-shaped tear-off strip between said lines of perforation.

2. The shrinking film package as claimed in claim 1 wherein:

said perforations extend through said three layers of overlapped film.

3. The shrinking film package as claimed in claim 2 and further comprising:

a break-off notch in said tear-off strip between said two lines of perforations.

4. The shrinking film package as claimed in claim 3 wherein:

said at least one article comprises at least one tray, each tray containing a plurality of articles arranged thereon and separated by at least one boundary between said articles; and said tear-off strip is disposed substantially along said at least one boundary.

5. The shrinking film package as claimed in claim 4 wherein:

said film comprises a single piece of heat-shrinkable film wrapped around said at least one article and having overlapped welded edges; and said tape-shaped tear-off strip extends substantially transversely to said overlapped edges.

6. The shrinking film package as claimed in claim 1 and further comprising:

a break-off notch is said tearoff strip between said two lines of perforations.

7. The shrinking film package as claimed in claim 1 wherein:

said at least one article comprises at least one tray, each tray containing a plurality of articles arranged thereon and separated by at least one boundary between said articles; and said tear-off strip is disposed substantially along said at least one boundary.

8. The shrinking film package as claimed in claim 1 wherein:

said film comprises a single piece of heat-shrinkable film wrapped around said at least one article and having overlapped welded edges; and said tape-shaped tear-off strip extends substantially transversely to said overlapped edges.

* * * * *